US008671850B2

(12) United States Patent
Smith et al.

(10) Patent No.: US 8,671,850 B2
(45) Date of Patent: Mar. 18, 2014

(54) CONVERTIBLE TABLETOP WITH PIVOTAL MODESTY PANEL

(75) Inventors: Richard D. Smith, Spanish Fork, UT (US); Grant Rogers, Sanford, MI (US)

(73) Assignee: Mity-Lite, Inc., Orem, UT (US)

( * ) Notice: Subject to any disclaimer, the term of this patent is extended or adjusted under 35 U.S.C. 154(b) by 192 days.

(21) Appl. No.: 13/283,077

(22) Filed: Oct. 27, 2011

(65) Prior Publication Data

US 2013/0104781 A1 May 2, 2013

(51) Int. Cl.
*A47B 1/00* (2006.01)

(52) U.S. Cl.
USPC ..... 108/65; 108/69; 108/166; 312/313

(58) Field of Classification Search
USPC ..... 108/17, 11, 50.11, 65, 66, 69, 68, 70, 108/71, 72, 73, 75, 77, 102, 162, 166, 137; 16/242, 239, 362, 368; 49/254; 312/313, 240, 241
See application file for complete search history.

(56) References Cited

U.S. PATENT DOCUMENTS

| | | | | |
|---|---|---|---|---|
| 50,891 | A | 11/1856 | Batchelor | |
| 158,063 | A * | 12/1874 | Grimm | 16/364 |
| 811,209 | A | 1/1906 | Farrell | |
| 827,834 | A | 8/1906 | Westby | |
| 953,413 | A | 3/1910 | Eggers | |
| 1,007,727 | A | 11/1911 | Onken | |
| 1,335,704 | A | 3/1920 | Russell et al. | |
| 1,439,002 | A | 12/1922 | Jourdan | |
| 1,526,009 | A | 2/1925 | Partington | |
| 1,542,138 | A | 6/1925 | Hunter | |
| 1,641,495 | A | 9/1927 | Krick | |
| 1,646,175 | A | 10/1927 | Thiede | |
| 1,684,966 | A | 9/1928 | O'Conor | |
| 1,801,080 | A | 4/1931 | Hart et al. | |
| 1,860,644 | A | 5/1932 | Bales et al. | |
| 1,888,117 | A | 11/1932 | Fox | |
| 1,891,734 | A | 12/1932 | Slee | |
| 2,162,777 | A | 6/1939 | Hagopian | |
| 2,278,331 | A | 3/1942 | Mayercord | |
| 2,304,718 | A | 12/1942 | Swart | |
| 2,358,174 | A * | 9/1944 | McFall | 108/77 |
| 2,374,670 | A | 5/1945 | Duke | |
| 2,535,920 | A | 12/1950 | Hart et al. | |
| 2,539,461 | A | 1/1951 | Norquist | |
| 2,542,860 | A | 2/1951 | Clements | |
| 2,650,185 | A | 8/1953 | Larson et al. | |

(Continued)

FOREIGN PATENT DOCUMENTS

| | | |
|---|---|---|
| DE | 3641967 | 10/1987 |
| EP | 2227984 | 9/2010 |

OTHER PUBLICATIONS

U.S. Appl. No. 13/283,130, filed Oct. 27, 2011; Grant Rogers; office action dated Dec. 5, 2012.

(Continued)

*Primary Examiner* — Daniel Rohrhoff
(74) *Attorney, Agent, or Firm* — Thorpe North & Western LLP

(57) ABSTRACT

A convertible table has a modesty panel pivotally coupled to a tabletop by a hinge fixed to the tabletop. The modesty panel is slidably coupled to the hinge and movable towards and away from the tabletop.

22 Claims, 7 Drawing Sheets

(56) References Cited

U.S. PATENT DOCUMENTS 2,681,261 A 10/1953 Blink
2,657,964 A 11/1953 Watrous
2,690,369 A 9/1954 Laskey et al.
2,714,743 A * 8/1955 David Lochner ..... 16/364
2,786,727 A 3/1957 Nordmark
2,815,529 A * 12/1957 Herbolsheimer et al. ..... 16/363
2,851,322 A 9/1958 Molla
2,860,383 A 11/1958 Heisler
2,889,184 A 6/1959 Golff
2,889,185 A 6/1959 Heisler
2,905,334 A 9/1959 Gottschalk et al.
2,940,805 A 6/1960 Nordmark
2,978,895 A 4/1961 Heisler
2,996,764 A 8/1961 Ross et al.
3,021,575 A 2/1962 Heisler
3,061,369 A 10/1962 Haunost
3,065,860 A 11/1962 Swanson
3,074,770 A 1/1963 Joos
3,086,657 A 4/1963 Myers
3,150,032 A 9/1964 Rubenstein
3,159,114 A 12/1964 Haunost
3,164,110 A 1/1965 Bofinger
3,174,893 A 3/1965 Church et al.
3,190,649 A 6/1965 Heisler
3,213,570 A 10/1965 Abramson, Jr.
3,219,401 A 11/1965 Mapson
3,223,056 A 12/1965 Wilburn
3,328,500 A 6/1967 Barnette
3,337,662 A 8/1967 Spencer
3,351,369 A 11/1967 Hogstrom
3,475,030 A 10/1969 Prescott
3,610,175 A 10/1971 Wilton et al.
3,622,216 A 11/1971 Haunost
3,628,470 A 12/1971 De Luca
3,698,329 A 10/1972 Diamond et al.
3,700,533 A 10/1972 Schmitz
3,724,078 A 4/1973 Carlin et al.
3,761,554 A 9/1973 Barnette
3,832,264 A 8/1974 Barnette
3,836,043 A 9/1974 Levin
3,837,298 A 9/1974 Leonhart
3,856,451 A 12/1974 Holzinger
3,880,092 A 4/1975 Seeber et al.
3,915,098 A 10/1975 Nania
3,920,295 A 11/1975 Speckin
3,960,354 A 6/1976 Simikoski
3,962,390 A 6/1976 Mori et al.
3,971,181 A 7/1976 Zetlin
3,999,397 A 12/1976 Albery
4,099,887 A 7/1978 Mackenroth
4,101,233 A 7/1978 McConnell
4,111,482 A 9/1978 Jones
4,112,855 A 9/1978 Colby
4,138,953 A 2/1979 Tashman
4,278,196 A 7/1981 Ford
4,337,107 A 6/1982 Eshleman
4,341,164 A 7/1982 Johnson
4,397,247 A 8/1983 Lemelson
4,446,796 A * 5/1984 Wilson et al. ..... 108/69
4,503,780 A 3/1985 Apissomian
D280,371 S 9/1985 Bayly
4,560,523 A 12/1985 Plumley et al.
4,569,496 A 2/1986 Fleishman
4,606,170 A 8/1986 Mendenhall
4,646,654 A * 3/1987 Sullivan ..... 108/69
4,671,753 A 6/1987 Payne
4,676,041 A 6/1987 Ford
4,689,257 A 8/1987 Baum
4,696,406 A 9/1987 Karashima
4,706,436 A 11/1987 Mabey et al.
4,708,183 A 11/1987 Figueroa
4,715,503 A 12/1987 Johnson
4,727,816 A 3/1988 Virtue
4,735,151 A * 4/1988 Bisbing ..... 108/69
4,749,533 A 6/1988 Payne
4,750,432 A * 6/1988 McNamara et al. ..... 108/69
4,805,541 A 2/1989 Drane et al.
4,809,755 A 3/1989 Pontikas
4,827,850 A * 5/1989 Diffrient ..... 108/60
4,841,877 A 6/1989 Virtue
4,883,001 A 11/1989 Roth
4,904,022 A 2/1990 Morozzi
4,927,107 A 5/1990 Mateo Maria
4,998,697 A 3/1991 Esposito
5,011,636 A 4/1991 Payne
5,044,690 A 9/1991 Torrey
5,081,725 A 1/1992 Neese
5,102,077 A 4/1992 Glendinning
5,114,265 A 5/1992 Grisley
5,142,996 A 9/1992 Thorn
5,152,481 A 10/1992 Cote et al.
5,152,591 A 10/1992 Beals
5,173,348 A 12/1992 Gevaert et al.
5,213,861 A 5/1993 Severson et al.
5,241,914 A 9/1993 Korb
D341,271 S 11/1993 Pesso
5,259,305 A 11/1993 Korb
5,271,338 A 12/1993 Bonham
5,284,100 A 2/1994 Thorn
5,311,825 A 5/1994 Bonham
5,320,048 A 6/1994 Feiner
5,362,063 A 11/1994 Cummings
5,366,675 A 11/1994 Needham
5,374,180 A 12/1994 Bauer
5,389,316 A 2/1995 Kerman
5,394,808 A 3/1995 Dutro et al.
5,436,048 A 7/1995 Meier et al.
5,440,857 A 8/1995 Shanok et al.
5,443,020 A 8/1995 Price
5,464,305 A 11/1995 Liem
5,473,997 A 12/1995 Solomon et al.
5,490,467 A 2/1996 Diffrient
5,527,579 A 6/1996 Aho
5,532,282 A 7/1996 Needham
5,549,055 A 8/1996 Kusch
5,562,051 A 10/1996 Rizzi
D377,723 S 2/1997 Schacht
5,638,761 A 6/1997 Berkowitz et al.
5,678,491 A 10/1997 Price et al.
5,694,865 A 12/1997 Raab
5,709,155 A * 1/1998 Terracciano ..... 108/42
5,732,637 A 3/1998 Raab
5,759,472 A 6/1998 DeFranco et al.
5,783,611 A 7/1998 Strebel
5,865,128 A 2/1999 Tarnay
5,868,081 A 2/1999 Raab
5,871,219 A 2/1999 Elliott
5,888,114 A 3/1999 Slocum et al.
D412,254 S 7/1999 Gower
5,928,584 A 7/1999 Lee et al.
5,947,037 A 9/1999 Hornberger et al.
5,964,165 A 10/1999 Schmidt et al.
5,983,807 A 11/1999 Tarnay et al.
6,018,927 A 2/2000 Major
6,024,903 A 2/2000 Naft et al.
6,058,854 A 5/2000 Tarnay et al.
6,083,434 A 7/2000 Strebel
6,127,019 A 10/2000 Means
6,180,203 B1 1/2001 Unkles
6,199,489 B1 3/2001 Tsai
6,245,266 B1 6/2001 Ramesh
6,261,490 B1 7/2001 Kliene
D448,938 S 10/2001 Ng et al.
6,308,469 B1 10/2001 Leung
6,334,504 B1 1/2002 Sato et al.
D456,155 S 4/2002 DeVriendt
6,389,989 B1 5/2002 Hagerty
6,401,631 B1 6/2002 Kane et al.
6,536,359 B2 3/2003 Liu
6,615,743 B2 9/2003 Nien
6,694,897 B2 2/2004 Lou-Hao
6,712,009 B2 3/2004 Buntru et al.
6,772,700 B2 8/2004 Wong
6,824,860 B2 11/2004 Edwards et al.

(56) References Cited

U.S. PATENT DOCUMENTS

| | | | | |
|---|---|---|---|---|
| 6,837,171 | B1 | 1/2005 | Clark et al. | |
| 6,848,370 | B1 | 2/2005 | Stanford | |
| 6,892,860 | B2 | 5/2005 | Gibson et al. | |
| 6,901,867 | B2 | 6/2005 | Strong et al. | |
| 6,915,748 | B2 | 7/2005 | Stanford | |
| 6,915,749 | B2 | 7/2005 | Chang | |
| 6,920,833 | B2 | 7/2005 | Lou-Hao | |
| 6,959,651 | B2 | 11/2005 | Li | |
| 6,971,321 | B1 | 12/2005 | Strong | |
| D519,746 | S | 5/2006 | Ng et al. | |
| 7,059,255 | B2 | 6/2006 | Tsai | |
| 7,143,702 | B2 | 12/2006 | Stanford | |
| 7,150,237 | B2 | 12/2006 | Lin et al. | |
| 7,157,034 | B2 | 1/2007 | Bristow et al. | |
| 7,171,911 | B1 | 2/2007 | Rivera, Jr. et al. | |
| 7,178,471 | B2 | 2/2007 | Strong et al. | |
| D541,549 | S | 5/2007 | Ng et al. | |
| 7,229,231 | B2 | 6/2007 | Yu | |
| 7,251,920 | B2 | 8/2007 | Timmerman et al. | |
| 7,270,062 | B1 | 9/2007 | Larson | |
| 7,278,361 | B2 | 10/2007 | Zhurong et al. | |
| 7,360,343 | B1 | 4/2008 | Spransy et al. | |
| 7,361,123 | B1 | 4/2008 | Krull | |
| 7,472,655 | B2 | 1/2009 | Leng | |
| 7,509,914 | B2 | 3/2009 | Murphy | |
| 7,530,142 | B2 * | 5/2009 | Sutterlutti et al. | 16/242 |
| 7,641,414 | B1 | 1/2010 | Joyce | |
| 7,703,398 | B2 | 4/2010 | Brauning et al. | |
| 8,297,208 | B2 | 10/2012 | Hoffman | |
| 2002/0096094 | A1 | 7/2002 | Lira | |
| 2002/0152934 | A1 | 10/2002 | Haney | |
| 2002/0170470 | A1 * | 11/2002 | Cheng | 108/69 |
| 2003/0044231 | A1 | 3/2003 | Anvick | |
| 2004/0045488 | A1 | 3/2004 | Danzik et al. | |
| 2004/0159622 | A1 | 8/2004 | Craft et al. | |
| 2005/0129921 | A1 | 6/2005 | Laws et al. | |
| 2005/0184419 | A1 | 8/2005 | Laws et al. | |
| 2005/0274306 | A1 | 12/2005 | Strong | |
| 2006/0032417 | A1 | 2/2006 | Goschy et al. | |
| 2006/0081158 | A1 | 4/2006 | Ingham | |
| 2006/0117702 | A1 | 6/2006 | Lin | |
| 2006/0260519 | A1 | 11/2006 | Burns | |
| 2006/0286336 | A1 | 12/2006 | Darcy, III et al. | |
| 2007/0039523 | A1 | 2/2007 | Helzer et al. | |
| 2007/0157857 | A1 | 7/2007 | Bottemiller | |
| 2007/0227412 | A1 | 10/2007 | Voris | |
| 2007/0227416 | A1 | 10/2007 | Wang | |
| 2007/0256614 | A1 | 11/2007 | Chen | |
| 2008/0211128 | A1 | 9/2008 | Lucier et al. | |
| 2008/0258514 | A1 | 10/2008 | Nichols et al. | |
| 2009/0078173 | A1 * | 3/2009 | Topham et al. | 108/77 |
| 2009/0199746 | A1 | 8/2009 | Horton | |
| 2010/0186638 | A1 | 7/2010 | Roy et al. | |
| 2010/0275822 | A1 | 11/2010 | Elford | |

OTHER PUBLICATIONS

Web Page: www.Amazon.com: Eastman Outdoors Aluminum Folding Table/dp/B00006JEGG; printed Jan. 26, 2009; 7 pages.

Web Page: www.bristrotablesandbases.com/woodard/woven.htm; printed Jan. 26, 2006; 2 pgs.

Web Page: www.southernaluminum.com/catalog/pages/page1_p.html; printed Jan. 26, 2009; 13 pages.

Web Page: www.southernaluminum.com/alulite_tables/benefits.html: printed Jan. 26, 2009; 4 pgs.

Web Page: www.jointech.com/tablesaw_fl... Saw Train Floating Tables; printed Oct. 6, 2008; 3 pgs.

Web Page www.southernaluminum.com/alulite_tables/specifications.HTML: printed Jan. 26, 2009; 2pgs.

Web Page: www.tropitone.com; printed Jan. 26, 2009; 2 pgs.

U.S. Appl. No. 13/283,130, filed Oct. 27, 2011; Grant Rogers.

Southern Aluminum, Installation and Product Photos; http://www.southernaluminum.com/gallery.php?9num; as accessed on Feb. 17, 2011; 1 page.

Southern Aluminum, Installation and Product Photos; http://www.southernaluminum.com/gallery.php?9num; as accessed Feb. 17, 2011; 1 page.

http://www.southernaluminum.com/catalog/pages/page6_p.html; 1 page; as accessed on Feb. 17, 2011.

T2 [two tables in one]; http://www.southernaluminum.com/t2/specifications.html; as accessed Feb. 17, 2011; 1 page.

* cited by examiner

CONVERTIBLE TABLETOP WITH PIVOTAL MODESTY PANEL

BACKGROUND

1. Field of the Invention

The present invention relates generally to convertible tables or tables with modesty panels.

2. Related Art

Some tables are configured to have a folding modesty panel. For example, see U.S. Pat. No. 4,827,850. Other types of tables have a folding leaf. For example, see U.S. Pat. Nos. 2,358,174; 4,446,796; and 4,750,432.

The moving leaf or modesty panel can create a pinch point in which a user's fingers or other objects can become caught and injured or damaged as the leaf or panel pivots.

SUMMARY OF THE INVENTION

It has been recognized that it would be advantageous to develop a convertible table with a modesty panel that can pivot to extend a width of the table. In addition, it has been recognized that it would be advantageous to develop a convertible table with a pivotal hinge connection that resist pinch points or pinching.

The invention provides a convertible table device with a tabletop with a horizontal orientation supported in an elevated position by legs. The tabletop has a front edge and a bottommost edge. A modesty panel is pivotally coupled to the tabletop and is pivotal between two configurations, including: a lowered position in which the modesty panel is vertically oriented and hangs from the tabletop, and a raised position in which the modesty panel is horizontally oriented and abuts the front edge of the tabletop with a top surface of the modesty panel flush with a top surface of the tabletop. A hinge is fixed to the tabletop and pivotally couples the modesty panel to the tabletop. The hinge has a pivot axel fixed with respect to the tabletop and located inward with respect to the front edge. The hinge is configured and the pivotal axel is located so that the top surface of the modesty panel is positioned at or behind the front edge of the tabletop in the lowered position. The modesty panel is slidably coupled to the hinge and movable towards and away from the pivot axel between two positions, including: an extended position in which the modesty panel is displaced away from the tabletop forming a gap therebetween, and a retracted position in which the modesty panel is displaced towards the tabletop. A spring is coupled between the modesty panel and the hinge to bias the modesty panel in the retracted position.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The term "convertible table" is used herein to refer to a table with a modesty panel that can convert from a modesty panel to a part of the tabletop. Such a table can be used as a normal table with standard widths, such as 30 inches, with the modesty panel raised and forming a part of the tabletop. In addition, such a table can be used as a table with the modesty panel lowered. Furthermore, the modesty panel can provide privacy or shielding for a user's waist and legs, particularly when the table is on an elevated platform. The table can be a folding table with legs that fold against the table for storage.

The term "modesty panel" is used herein to refer to a panel that acts as a modesty panel or a drop leaf.

The term "support surface" and "ground" are used interchangeably herein to refer to a support surface, such as the ground, a floor, a stage, a platform, etc. upon which the table is disposed or supported.

DESCRIPTION

Figure 9:
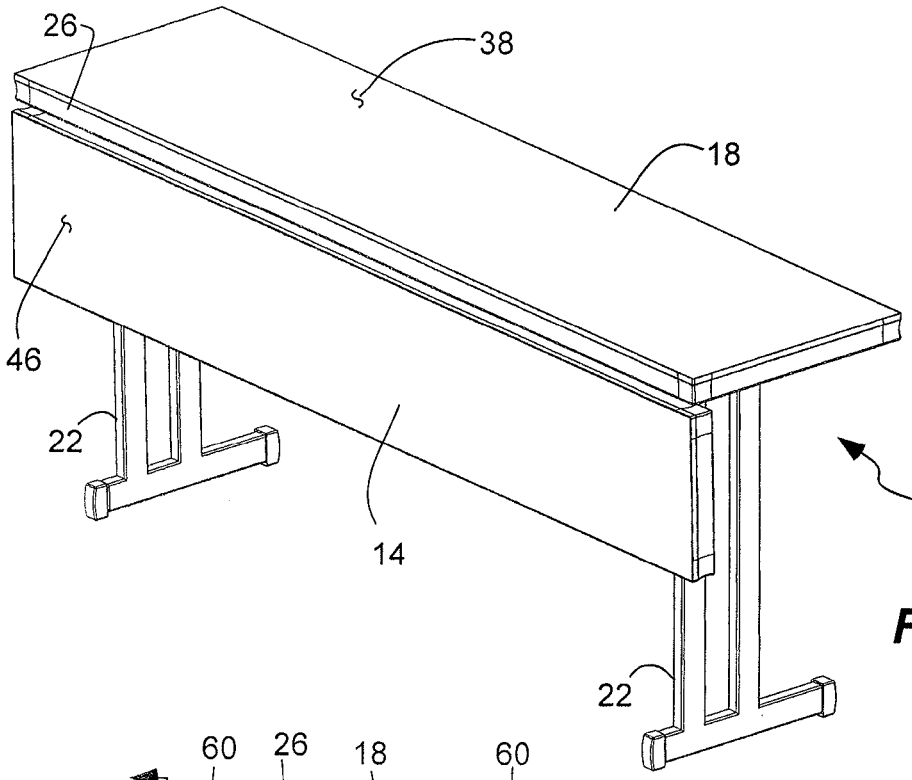
FIG. 9 is a front perspective view of the table of FIG. 1.
Figure 10:
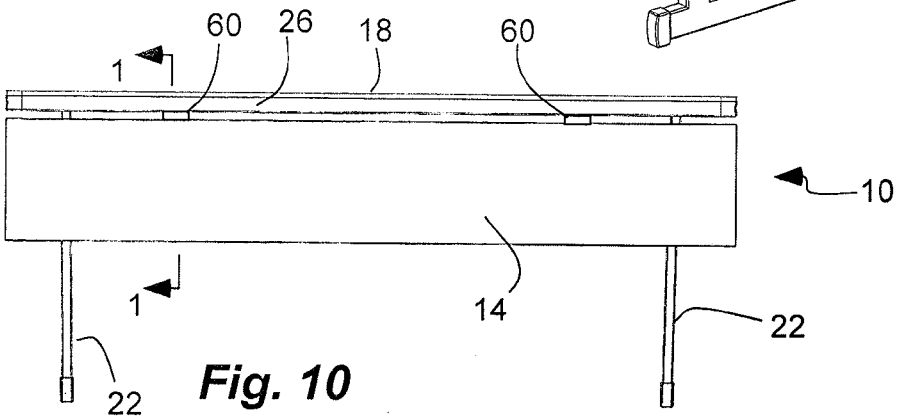
FIG. 10 is a front view of the table of FIG. 1.
Figure 11:
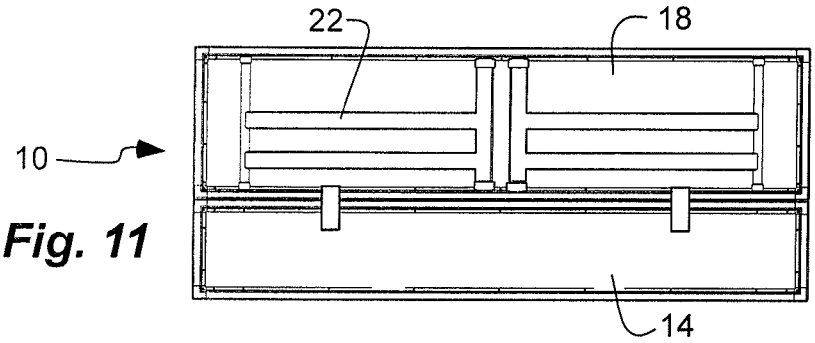
FIG. 11 is a bottom view of the table of FIG. 1, with the modesty panel in a raised position, and the legs in a closed storage position.
Figure 12:
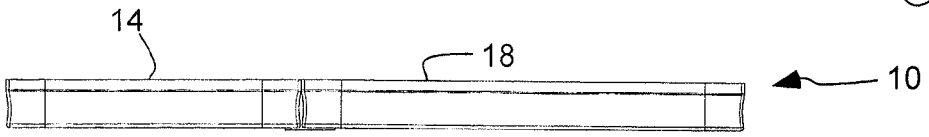
FIG. 12 is a side view of the table of FIG. 1, with the modesty panel in a raised position, and the legs in a closed storage position.

As illustrated in FIGS. 1-12, a convertible table, indicated generally at 10, in an example implementation in accordance with the invention is shown with a modesty panel 14. The table 10 also has a tabletop 18 with a horizontal orientation supported in an elevated position with respect to a support surface one or more legs or leg assemblies, indicated at 22. For example, the table or tabletop can be elongated with a pair of leg assemblies disposed on either end or opposite halves thereof, as shown in FIGS. 9 and 10. The legs 22 can be pivotally coupled to the tabletop, or bottom thereof, and pivotal between a closed storage position against the tabletop (as shown in FIGS. 11 and 12), and an open elevated position extending transverse between the support surface and the tabletop (as shown in FIGS. 1-10). In addition, the tabletop has a front edge 26, and a bottom-most edge 30. Furthermore, the tabletop can includes a sheet 34, such a plywood or laminate, with a top surface 38, and a perimeter support frame 42, such as tubular metal, supporting the sheet and extending around some or all of a perimeter of the tabletop. The support frame can define an interior space under the tabletop or sheet into which the legs can be folded in the closed storage position. In addition, the support frame can also define all or a portion of the front edge 26 of the tabletop.

Figure 1:
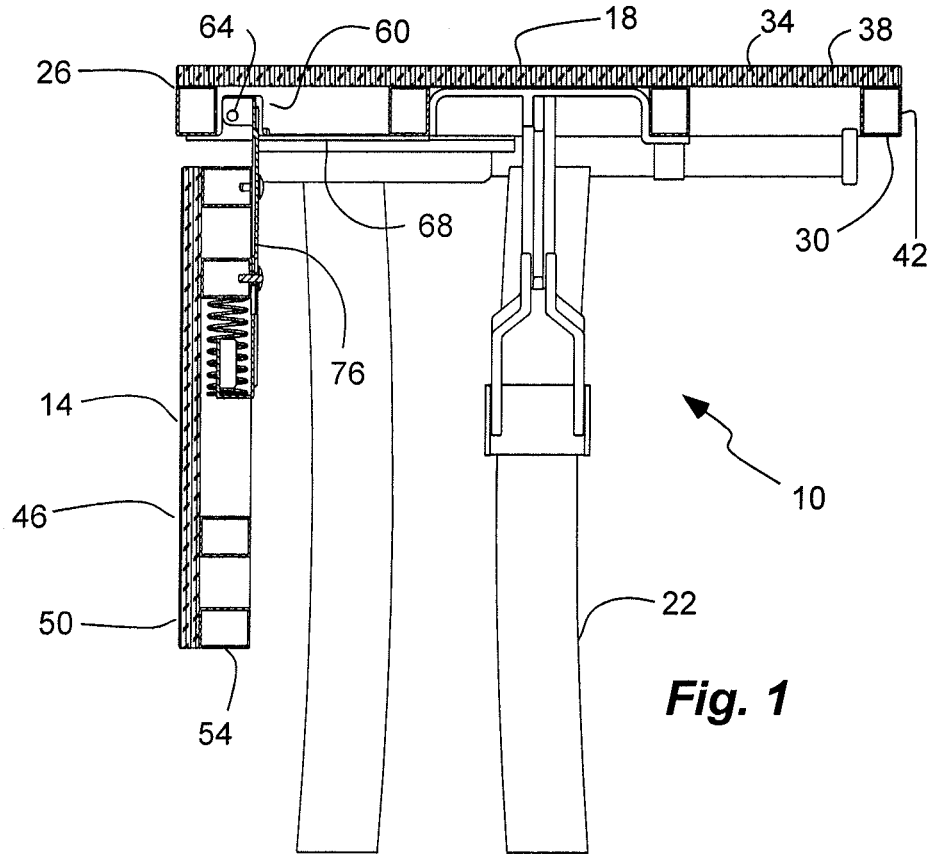
FIG. 1 is a cross-sectional side view of a table in accordance with an embodiment of the present invention, taken along line 1 of FIG. 10, with a modesty panel is a lowered position and a retracted position, and legs in an open elevated position.
Figure 2:
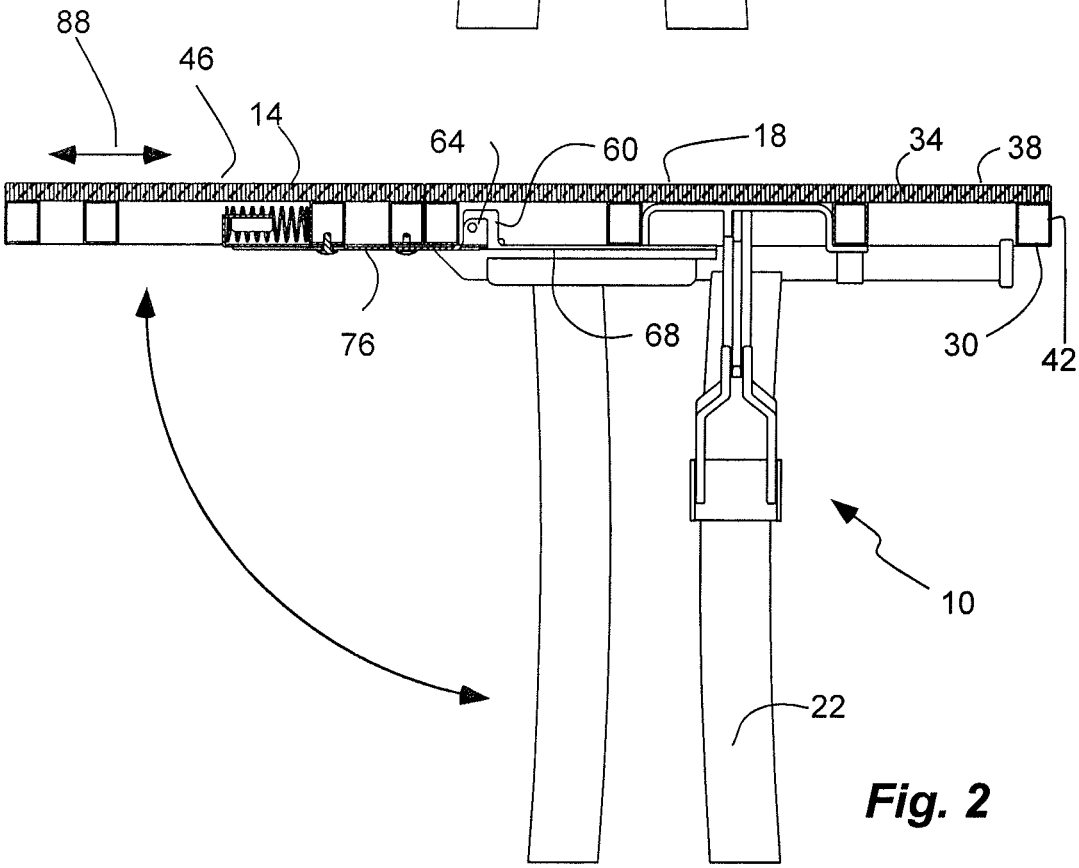
FIG. 2 is a cross-sectional side view of the table of FIG. 1, with the modesty panel in a raised position and a retracted position.
Figure 3:
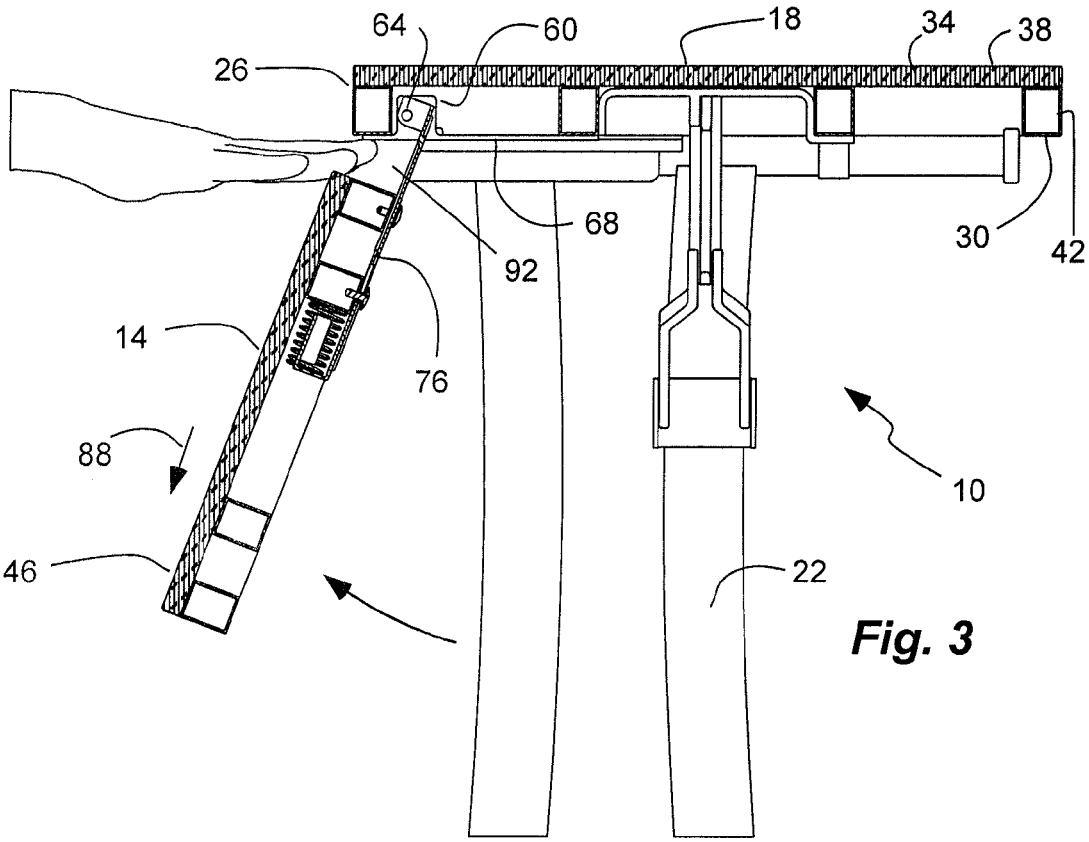
FIG. 3 is a cross-sectional side view of the table of FIG. 1, with the modesty panel in an extended position and an intermediate position.
Figure 4:
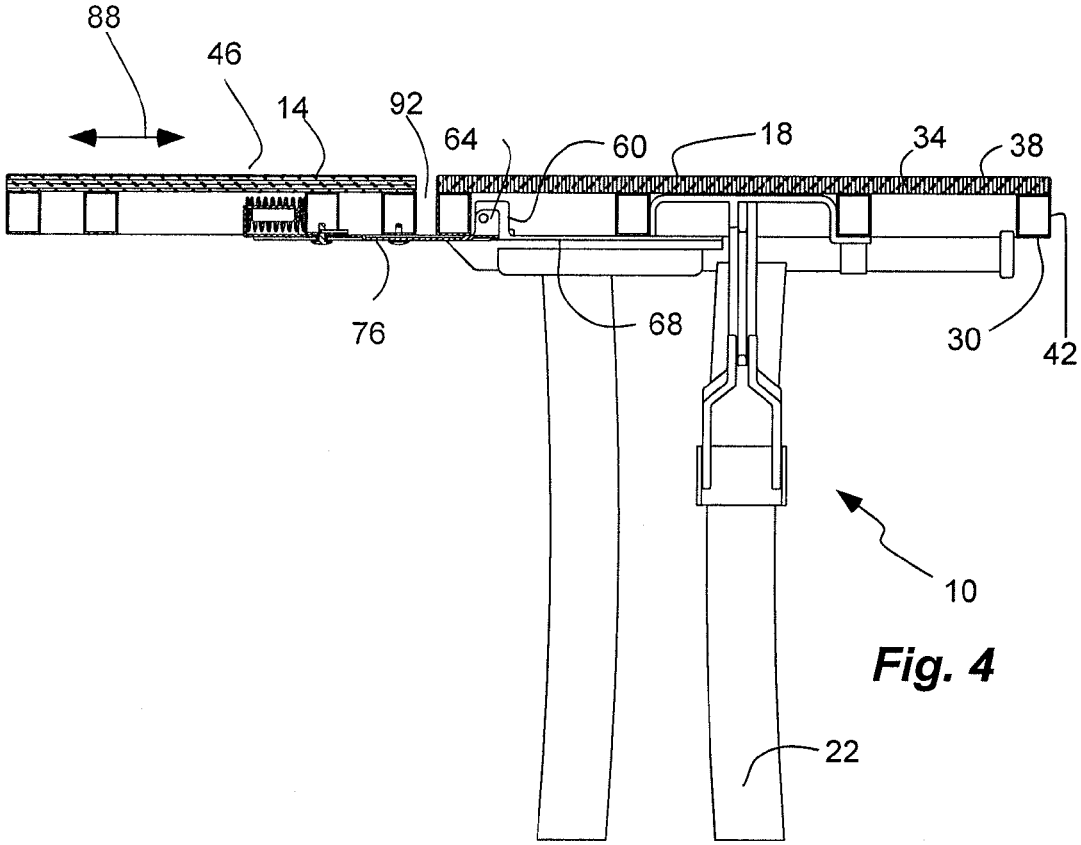
FIG. 4 is a cross-sectional side view of the table of FIG. 1, with the modesty panel in the raised position and the extended position.
Figure 5:
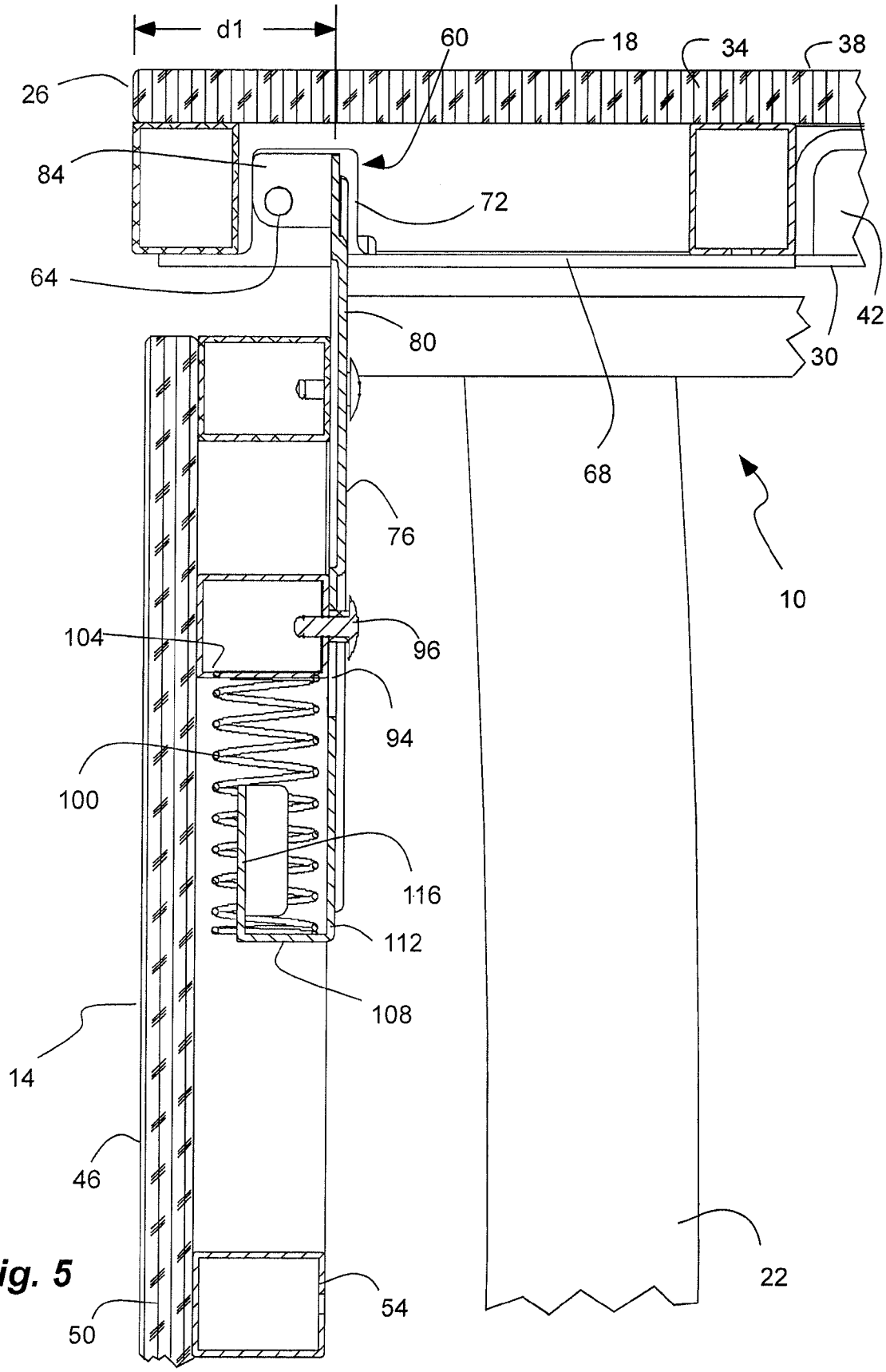
FIG. 5 is a detailed cross-sectional side view of the table of FIG. 1, with a modesty panel is the lowered position and the retracted position (like FIG. 1)
Figure 6:
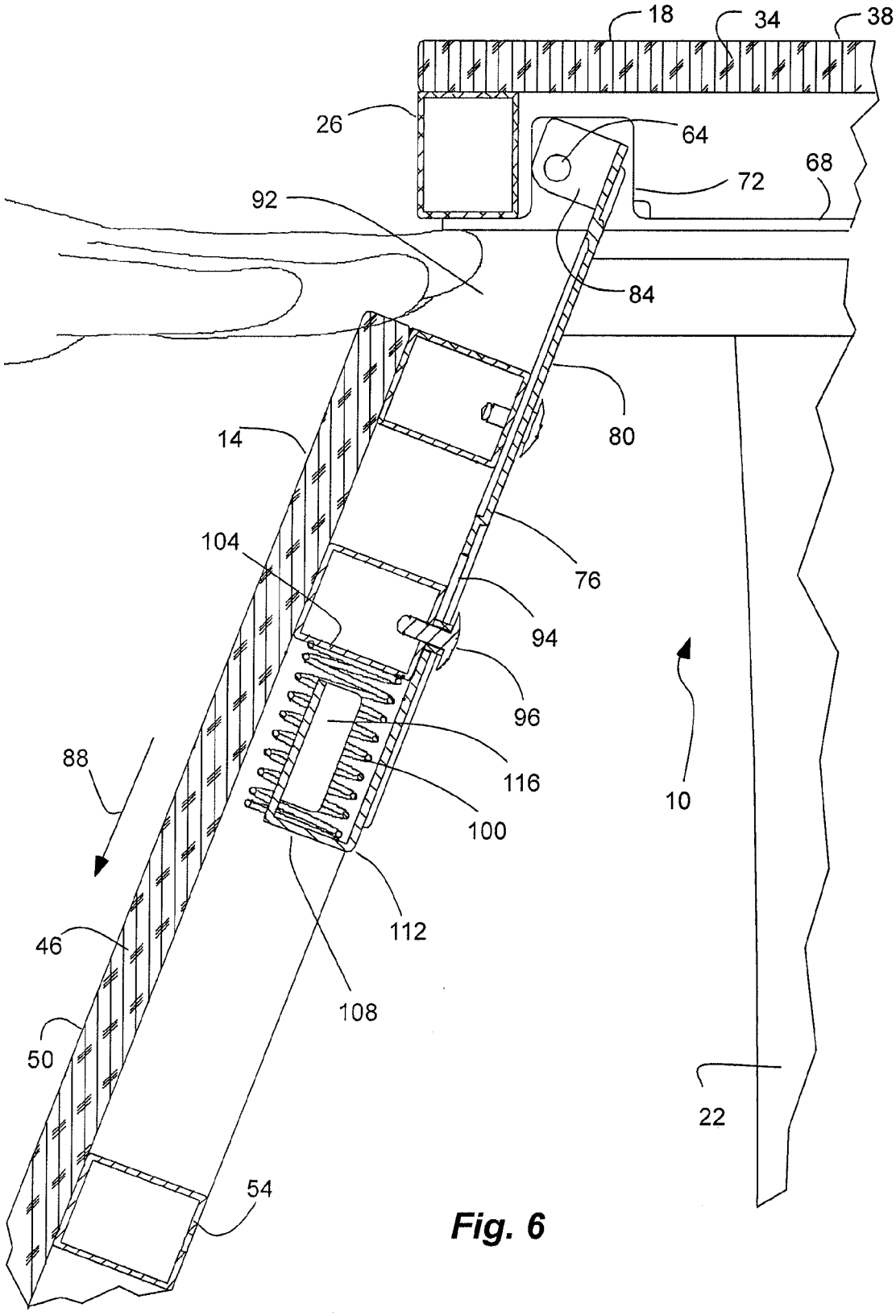
FIG. 6 is a detailed cross-sectional side view of the table of FIG. 1, with the modesty panel in the extended position and the intermediate position (like FIG. 3)
Figure 7:
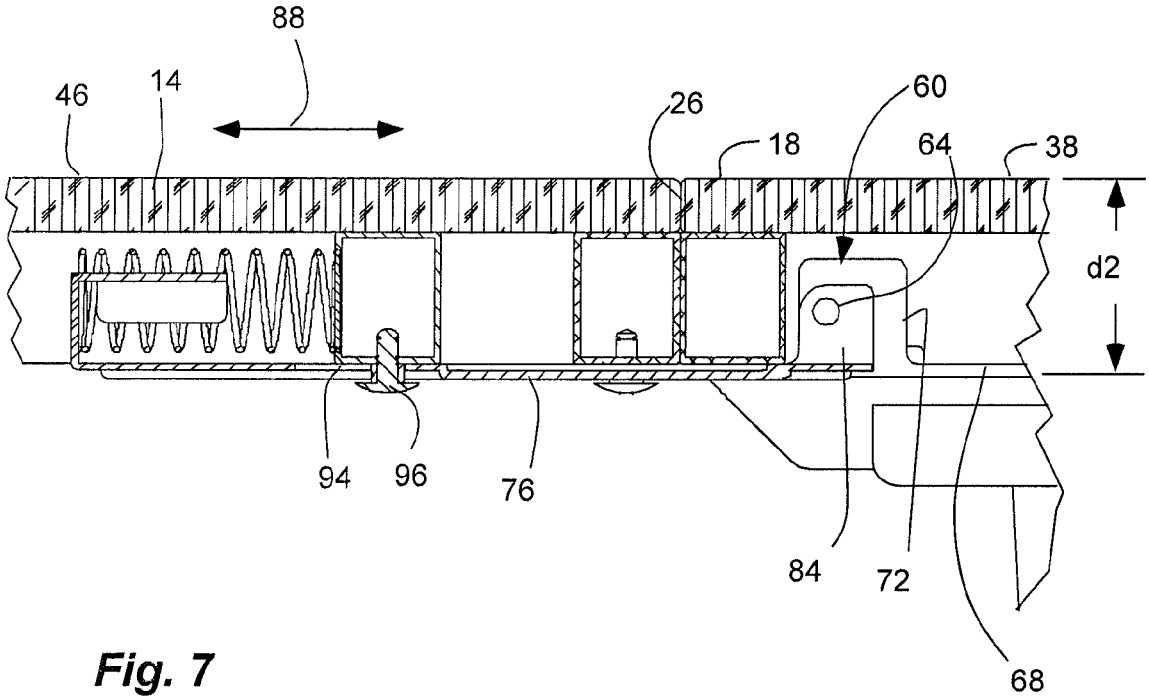
FIG. 7 is a detailed cross-sectional side view of the table of FIG. 1, with a modesty panel is the raised position and the retracted position (like FIG. 2)
Figure 8A:
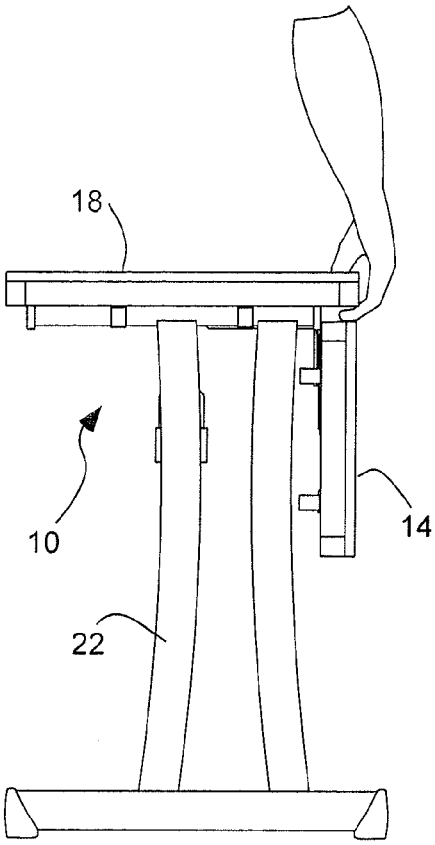
FIGS. 8*a*-8*c* are schematic side views of the table of FIG. 1, with the modesty panel moving between the lowered and the raised positions.
Figure 8B:
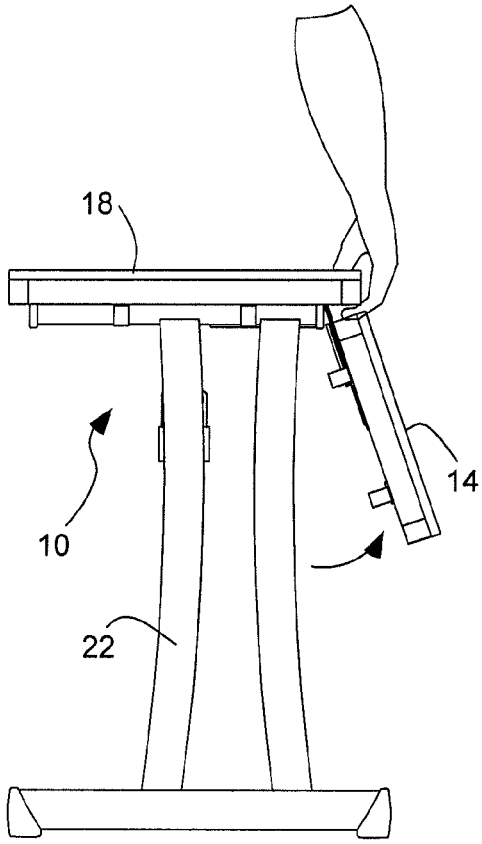
Figure 8C:
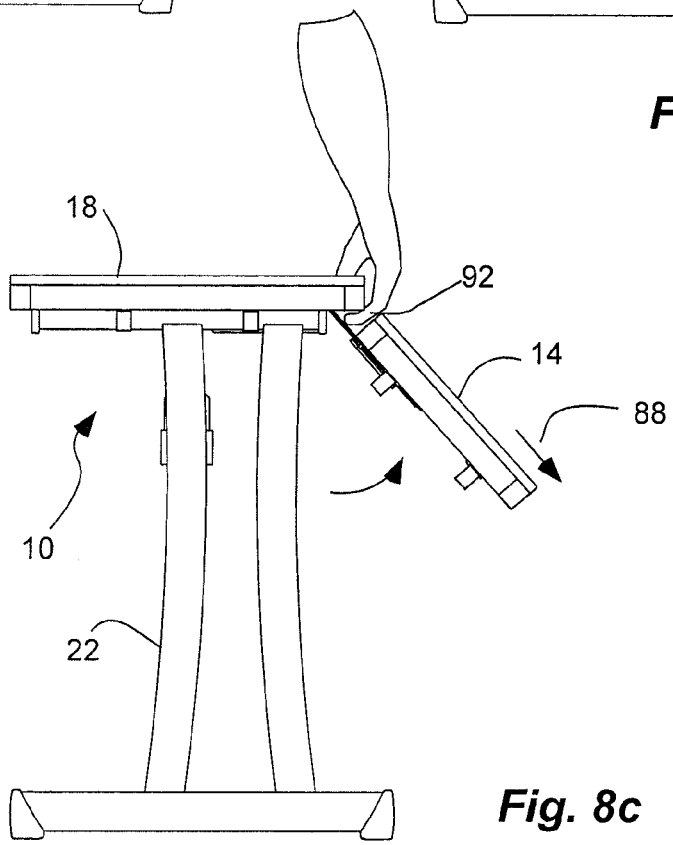

The modesty panel 14 is pivotally coupled to the tabletop 18, or bottom thereof. The modesty panel can pivot between two configurations, including a lowered position in which the modesty panel is vertically oriented and hangs from the tabletop (as shown in FIGS. 1, 5, 8*a*, 9 and 10), and a raised position in which the modesty panel 14 is horizontally oriented and abuts the front edge 26 of the tabletop 18 with a top surface 46 of the modesty panel flush or coplanar with the top surface 38 of the tabletop (as shown in FIGS. 2 and 7). A gap or smaller gap can be formed between the tabletop and the modesty panel in the lowered position. The modest panel 14 can include a sheet 50, such as plywood or laminate, forming the top surface of the modesty panel, and a support frame 54, such as tubular metal, supporting the sheet. The support frame 54 can extend around some or all of a perimeter of the modesty panel. The support frame 54 can define an interior space under the modesty panel or sheet. The modesty panel can have an interior or inside edge that abuts to the front edge 26 of the tabletop in the raised position.

The table 10 can also include one or more hinges 60, such as a pair of hinges, fixed to the tabletop 18, or the bottom thereof, and at opposite halves thereof. The hinges 60 are rigidly affixed to the tabletop, and pivotally couple the modesty panel 14 to the tabletop 18. Each hinge 60 has a pivot axel 64 rigidly fixed with respect to the tabletop 18, and located inward with respect to the front edge 26 of the tabletop, and above the bottom edge 30 of the tabletop. Thus, the pivot axel 64 of the hinge can be located behind the support frame 42, and in the interior space of the support frame 42. Each hinge 60 can include a fixed plate 68 rigidly fixed to the bottom of the tabletop 18, and a fixed flange 72 extending upward from the fixed plate into the space defined by the frame 42. The fixed flange 72 can have an aperture to receive or form the pivot axel. Thus, the fixed plate 68 attaches the hinge to the frame 42 of the tabletop, while the fixed flange 72 positions the pivot axel upward and inward with respect to the frame.

In addition, each hinge 60 can include a pivot hinge plate 76 coupled to the modesty panel 14 or the bottom or the frame 54 thereof, and pivotally coupled to the pivot axel and the fixed plate. The pivot hinge plate 76 can have a proximal end 80 extending beyond a perimeter or inner edge of the modesty panel. A pivot flange 84 can extend from the proximal end of the hinge plate 76 in a direction towards the top of the modesty panel, and into the space defined by the frame 42 of the tabletop and adjacent the fixed flange 72. The fixed flange 72 and the pivot flange 84 are parallel one another and pivotally coupled together by the pivot axel 64. The pivot axel can include a fastener, such as a rivet, extending through apertures in the flanges 72 and 84. The plates 68 and 76 can be transverse, or perpendicular or orthogonal to one another, in the lowered position, and parallel with one another in the raised position. The hinge(s) 60 is configured and the pivotal axel 64 is located so that the top surface 46 of the modesty panel 14 is positioned at or behind the front edge 26 of the tabletop 18 in the lowered position. Thus, the modesty panel does not protrude when lowered.

In addition, the modesty panel 14 is slidably coupled to each hinge 60, and movable towards and away from each pivot axel 64, indicated by 88, between two positions, including an extended position in which the modesty panel is displaced away from the tabletop forming a gap 92, or larger gap, therebetween (as shown in FIGS. 3, 4, 6 and 8*c*), and a retracted position in which the modesty panel is displaced towards the tabletop (as shown in FIGS. 1, 2, 5 and 7). The modesty panel 14 can simultaneously slide or displace 88 on the hinge as it pivots on the hinge. The gap 92 created by the modesty panel displacing away from the tabletop resists pinching, or creating a pinch point, between the modesty panel and the tabletop as the modesty panel pivots to the raised position. As demonstrated in FIGS. 8*a-c*, a user or bystander may have his or her fingers, or other object, located between the modesty panel and the tabletop; which would otherwise be pinched as the modesty panel pivots to the raised position; but which is avoided by expanding or enlarging the gap as the modestly panel also displaces away from the tabletop. Thus, an object inserted in the gap 92 between the modesty panel and the tabletop causes the modesty panel to move away from the tabletop and the pivot axel from the retracted position to the extended position to resist pinching the object as the modestly panel is raised. The hinge 60 or pivot hinge plate 76 can include one or more slots 94 which can be elongated and oriented with a longitudinal axis transverse to the pivot axel. One or more protrusions 96, such as a fastener or rivet, can extend from the modestly panel and into the slot 94. The protrusion or fastener can have an enlarged head on an opposite side of the pivot hinge plate opposite the modesty panel. The protrusion 96 or fastener can move in the slot as the modesty panel moves between the extended and retracted positions. Thus, the slots 94 allow the modesty panel to move with respect to the protrusions, fasteners, and hinge plate. The protrusion or fastener can also have a collar or bushing disposed thereon formed of plastic or other low friction material to facilitate sliding of the protrusion or fastener in the slot.

A spring 100 is coupled between the modesty panel 14 and the hinge 60 or pivot hinge plate 76 to bias the modesty panel in the retracted position. A face plate 104 can be disposed on the modesty panel, such as on or as a part of the frame. A distal flange 108 can be disposed on or formed at a distal end 112 of the pivot hinge plate 76, opposite the face plate of the modesty panel. A finger 116 can be disposed on or formed at the distal flange 108, and extending towards the face plate 104 of the modesty panel. The pivot hinge plate 76, pivot flange 84, distal flange 108, and the finger 116, can all be cut or stamped from a single piece of metal, and bent to form the plate, flanges and fingers. The spring 100 can be a coil spring disposed on the finger 116, and extending between the face plate 104 of the modesty panel and the distal flange 108 of the pivot hinge plate. Thus, the spring can push the modestly panel towards the tabletop. In addition, the spring can be located or positioned in the space defined by the frame.

Furthermore, the hinge can be configured so that the modesty panel or top surface 46 thereof is located behind the front edge 26 of the tabletop in the lowered position. The pivot hinge plate 76 can be off-set with respect to the pivot axel 64. A distance d1 (FIG. 5) between the front edge 26 of the tabletop and the pivot hinge plate 76 in the lowered position can be greater than a distance d2 (FIG. 7) between the top surface 38 of the tabletop and pivot hinge plate 76 in the raised position. The pivot axel 64 at the pivot flange 84 can be located at a midpoint relative to a thickness of the modesty panel so that the modesty panel is oriented substantially vertically in the lowered position.

The table can include a lock (not shown) to maintain the modesty panel in the raised position.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A convertible table device, comprising:

a) a tabletop with a horizontal orientation supported in an elevated position by legs, the tabletop having a front edge and a bottom-most edge;

b) a modesty panel pivotally coupled to the tabletop and pivotal between two configurations including a lowered position in which the modesty panel is vertically oriented and hangs from the tabletop, and a raised position in which the modesty panel is horizontally oriented and abuts the front edge of the tabletop with a top surface of the modesty panel flush with a top surface of the tabletop;

c) a hinge fixed to the tabletop and pivotally coupling the modesty panel to the tabletop;

d) the hinge having a pivot axel fixed with respect to the tabletop and located inward with respect to the front edge;

e) the hinge being configured and the pivotal axel being located so that the top surface of the modesty panel is positioned at or behind the front edge of the tabletop in the lowered position;

f) the modesty panel being slidably coupled to the hinge and movable towards and away from the pivot axel between two positions including an extended position in which the modesty panel is displaced away from the tabletop forming a gap therebetween, and a retracted position in which the modesty panel abuts the tabletop; and g) a spring coupled between the modesty panel and the hinge to bias the modesty panel in the retracted position.

2. A device in accordance with claim 1, further comprising:

a) a pivot hinge plate pivotally coupled to the modesty panel and pivotally coupled to the pivot axel;

b) at least one slot formed in the pivot hinge plate with a longitudinal axis transverse to the pivot axel; and c) at least one protrusion extending from the modestly panel and into the at least one slot, and movable in the slot as the modesty panel moves between the extended and retracted positions.

3. A device in accordance with claim 2, further comprising:

a) a face plate disposed on the modesty panel;

b) a distal flange disposed on a distal end of the pivot hinge plate opposite the face plate of the modesty panel;

c) a finger disposed on the distal flange and extending towards the face plate of the modesty panel; and d) the spring including a coil spring disposed on the finger and extending between the face plate of the modesty panel and the distal flange of the pivot hinge plate.

4. A device in accordance with claim 2, wherein the modest panel includes a sheet forming the top surface of the modesty panel and a support frame supporting the sheet; and wherein the spring is disposed inside a space defined by the support frame.

5. A device in accordance with claim 2, wherein the at least one protrusion includes a fastener with an enlarged head on an opposite side of the pivot hinge plate opposite the modesty panel.

6. A device in accordance with claim 2, wherein the pivot hinge plate is off-set with respect to the pivot axel; and wherein a distance between the front edge of the tabletop and the pivot hinge plate in the lowered position is greater than a distance between the top surface of the tabletop and pivot hinge plate in the raised position.

7. A device in accordance with claim 1, wherein the pivot axel is located behind the front edge of the tabletop and above the bottom-most edge of the tabletop.

8. A device in accordance with claim 1, wherein the tabletop further comprises:

a) a sheet;

b) a perimeter support frame supporting the sheet and extending around at least a portion of a perimeter of the tabletop; and wherein the hinge further comprises:

a) a fixed plate coupled to a bottom of the tabletop;

b) a fixed flange extending from the fixed plate into a space defined by the frame;

c) a pivot hinge plate coupled to the modesty panel;

d) a pivot flange extending from the pivot hinge plate into the space defined by the frame adjacent the fixed flange; and e) the fixed flange and the pivot flange being pivotally coupled together by the pivot axel.

9. A device in accordance with claim 1, wherein the hinge further comprises:

a) a pivot hinge plate coupled to a bottom of the modesty panel with a proximal end extending beyond a perimeter of the modesty panel;

b) a pivot flange extending from the proximal end of the pivot hinge plate in a direction towards the top of the modesty panel;

c) the pivot flange being pivotally coupled by the pivot axel at the pivot flange to the tabletop; and d) the pivot axel at the pivot flange being located at a midpoint relative to a thickness of the modesty panel so that the modesty panel is oriented substantially vertically in the lowered position.

10. A device in accordance with claim 1, wherein the tabletop includes a sheet forming the top surface of the tabletop and a support frame supporting the sheet; and wherein the support frame forms at least a portion of the front edge of the tabletop; and wherein the pivot axel is disposed behind the support frame at the front edge.

11. A device in accordance with claim 1, wherein an object inserted in the gap between the modesty panel and the tabletop causes the modesty panel to move away from the tabletop and the pivot axel from the retracted position to the extended position to resist pinching the object as the modesty panel is raised.

12. A device in accordance with claim 1, wherein the legs include a pair of opposite leg mechanisms pivotally coupled to opposite sides of the tabletop and pivotal between a closed position against the tabletop and an open position extending transverse to the tabletop.

13. A device in accordance with claim 1, wherein the modest panel includes a sheet forming the top surface of the modesty panel and a support frame supporting the sheet; and wherein the pivot axel is located behind the support frame and inside a space defined by the support frame.

14. A device in accordance with claim 1, wherein the modest panel displaces away from the pivot axel in a downward direction.

15. A convertible table device, comprising:

a) a tabletop with a horizontal orientation supported in an elevated position with respect to a support surface by at least a pair of legs or leg assemblies pivotally coupled at opposite sides of the tabletop and pivotal between a closed storage position against the tabletop and an open elevated position extending transverse between the support surface and the tabletop, the tabletop having a front edge and a bottom-most edge;

b) a modesty panel pivotally coupled to the tabletop and pivotal between two configurations including a lowered position in which the modesty panel is vertically oriented and hangs from the tabletop, and a raised position in which the modesty panel is horizontally oriented and abuts the front edge of the tabletop with a top surface of the modesty panel flush with a top surface of the tabletop;

c) at least a pair of hinges fixed to the tabletop and pivotally coupling the modesty panel to the tabletop;

d) each hinge having a pivot axel fixed with respect to the tabletop and located inward with respect to the front edge;

e) each hinge being configured and the pivotal axel being located so that the top surface of the modesty panel is positioned at or behind the front edge of the tabletop in the lowered position;

f) the modesty panel being slidably coupled to each hinge and movable towards and away from each pivot axel between two positions including an extended position in which the modesty panel is displaced away from the tabletop forming a gap therebetween, and a retracted position in which the modesty panel abuts the tabletop; and g) a spring coupled between the modesty panel and each hinge to bias the modesty panel in the retracted position.

16. A device in accordance with claim 15, wherein each hinge further comprises:

a) a pivot hinge plate coupled to the modesty panel and pivotally coupled to the pivot axel;

b) at least one slot formed in the pivot hinge plate with a longitudinal axis transverse to the pivot axel; and c) at least one protrusion extending from the modestly panel and into the at least one slot, and movable in the slot as the modesty panel moves between the extended and retracted positions.

17. A device in accordance with claim 16, wherein each hinge further comprises:

a) a face plate disposed on the modesty panel;

b) a distal flange disposed on a distal end of the pivot hinge plate opposite the face plate of the modesty panel;

c) a finger disposed on the distal flange and extending towards the face plate of the modesty panel; and d) the spring including a coil spring disposed on the finger and extending between the face plate of the modesty panel and the distal flange of the pivot hinge plate.

18. A device in accordance with claim 16, wherein the pivot hinge plate is off-set with respect to the pivot axel; and wherein a distance between the front edge of the tabletop and the pivot hinge plate in the lowered position is greater than a distance between the top surface of the tabletop and pivot hinge plate in the raised position.

19. A device in accordance with claim 15, wherein each pivot axel is located behind the front edge of the tabletop and above the bottom-most edge of the tabletop.

20. A device in accordance with claim 15, wherein the tabletop further comprises:

a) a sheet;

b) a perimeter support frame supporting the sheet and extending around at least a portion of a perimeter of the tabletop; and wherein each hinge further comprises:

a) a fixed plate coupled to a bottom of the tabletop;

b) a fixed flange extending from the fixed plate into a space defined by the frame;

c) a pivot hinge plate coupled to the modesty panel;

d) a pivot flange extending from the pivot hinge plate into the space defined by the frame adjacent the fixed flange; and e) the fixed flange and the pivot flange being pivotally coupled together by the pivot axel.

21. A device in accordance with claim 15, wherein each hinge further comprises:

a) a pivot hinge plate coupled to a bottom of the modesty panel with a proximal end extending beyond a perimeter of the modesty panel;

b) a pivot flange extending from the proximal end of the pivot hinge plate in a direction towards the top of the modesty panel;

c) the pivot flange being pivotally coupled by the pivot axel at the pivot flange to the tabletop; and d) the pivot axel at the pivot flange being located at a midpoint relative to a thickness of the modesty panel so that the modesty panel is oriented substantially vertically in the lowered position.

22. A convertible table device, comprising:

a) a tabletop with a horizontal orientation supported in an elevated position by legs, the tabletop having a front edge and a bottom-most edge;

b) a modesty panel pivotally coupled to the tabletop and pivotal between two configurations including a lowered position in which the modesty panel is vertically oriented and hangs from the tabletop, and a raised position in which the modesty panel is horizontally oriented and abuts the front edge of the tabletop with a top surface of the modesty panel flush with a top surface of the tabletop;

c) a hinge fixed to the tabletop and pivotally coupling the modesty panel to the tabletop;

d) the hinge having a pivot axel fixed with respect to the tabletop and located inward with respect to the front edge;

e) the hinge being configured and the pivotal axel being located so that the top surface of the modesty panel is positioned at or behind the front edge of the tabletop in the lowered position;

f) the hinge including a pivot hinge plate coupled to the modesty panel and pivotally coupled to the pivot axel;

g) at least one slot formed in the pivot hinge plate with a longitudinal axis transverse to the pivot axel;

h) the modesty panel being slidably coupled to the hinge and movable towards and away from the pivot axel between two positions including an extended position in which the modesty panel is displaced away from the tabletop forming a gap therebetween, and a retracted position in which the modesty panel abuts the tabletop;

i) at least one protrusion extending from the modestly panel and into the at least one slot, and movable in the slot as the modesty panel moves between the extended and retracted positions;

j) a face plate disposed on the modesty panel;

k) a distal flange disposed on a distal end of the pivot hinge plate opposite the face plate of the modesty panel;

l) a finger disposed on the distal flange and extending towards the face plate of the modesty panel; and m) a spring disposed on the finger and extending between the face plate of the modesty panel and the distal flange of the pivot hinge plate to bias the modesty panel in the retracted position.

* * * * *